US005210879A

United States Patent [19]

Miller

[11] Patent Number: 5,210,879

[45] Date of Patent: May 18, 1993

[54] FISHING WADERS HAVING A CLOSEABLE, INTEGRALLY FORMED EXTENDABLE TUBULAR MEMBER AT THE CROTCH

[76] Inventor: Glenn W. Miller, 914 Diamond St., Sellersville, Pa. 18960

[21] Appl. No.: 696,142

[22] Filed: May 6, 1991

[51] Int. Cl.[5] ..... A41D 13/00

[52] U.S. Cl. ..... 2/82; 2/79; 2/69; 2/227; 2/234; 2/DIG. 5; 2/2

[58] Field of Search ..... 2/82, 69, 79, 94, 227, 2/234, DIG. 5, 2

[56] References Cited

U.S. PATENT DOCUMENTS

| | | | |
|---|---|---|---|
| 291,854 | 1/1884 | Platt | 2/82 |
| 1,488,536 | 4/1924 | Fry | 2/82 |
| 2,853,758 | 9/1958 | Topf | 2/82 |
| 4,274,159 | 6/1981 | Schmidt | 2/2 |

*Primary Examiner*—Clifford D. Crowder
*Assistant Examiner*—Gloria Hale
*Attorney, Agent, or Firm*—Joseph W. Molasky & Associates

[57] ABSTRACT

Fishing waders equipped with opening and closing means so as to allow a fisherman to urinate without having to draw the garment down. The opening is in the form of a tubular member which may be coiled to return the garment to a water impervious mode.

6 Claims, 2 Drawing Sheets

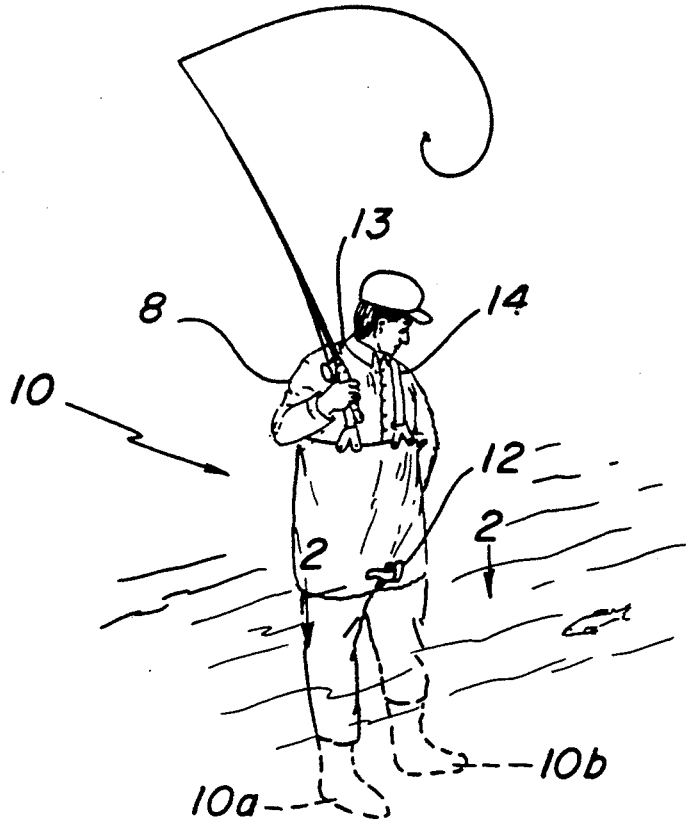
FIG. 1
FIG. 2
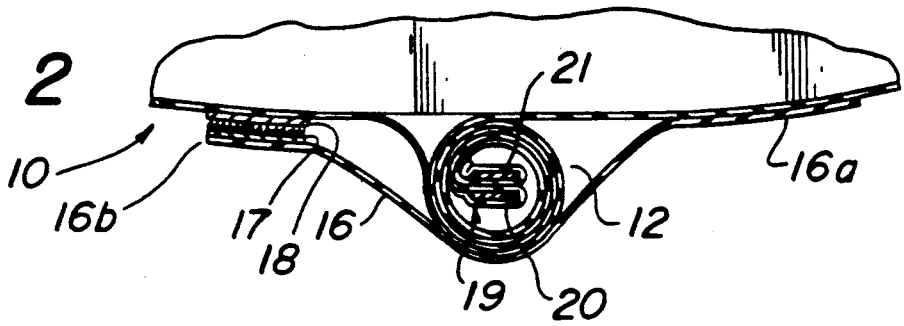
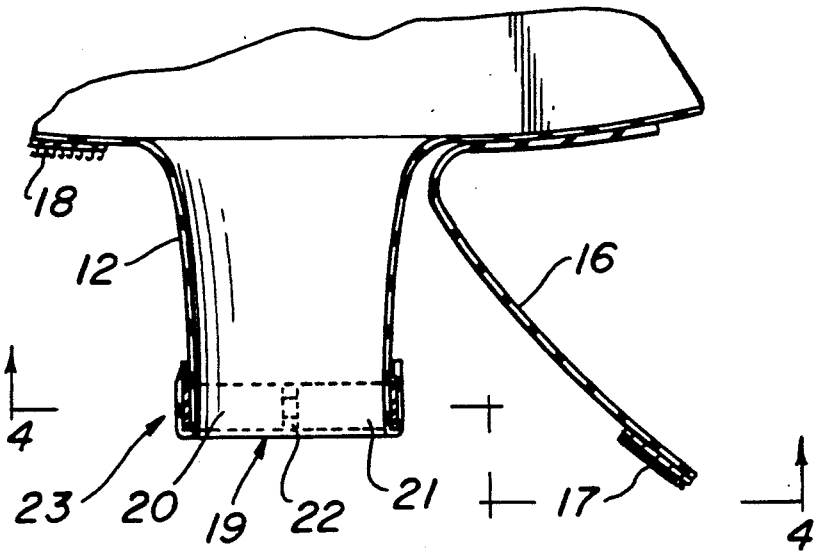
FIG. 3

FISHING WADERS HAVING A CLOSEABLE, INTEGRALLY FORMED EXTENDABLE TUBULAR MEMBER AT THE CROTCH

BACKGROUND OF THE INVENTION

The present invention relates in general to outerwear utilized in fly casting, surf fishing or bait casting and in particular to an improvement in the chest high waders employed in this sport.

Presently available waders do not allow for the facile expelling of liquid human waste. Instead, fishermen wearing state-of-the-art waders must relieve themselves by repairing to shore, dropping their suspenders and drawing down this garment so that they can pass their waste in the usual mode. This procedure is time consuming and inconvenient and fishermen have long expressed the need for some alternative.

It is clearly evident that the present-day wader design is not suitable for those persons actively engaged in the sport of fishing.

The present invention fulfills this need by providing fishing waders which are equipped with means for conveniently expelling urinary waste without undressing.

SUMMARY OF THE INVENTION

This invention provides fishing waders in which a closable opening is provided in the frontal area in the vicinity of the crotch. This opening is an extensible, flexible, and generally cylindrical or tubular member which opens to the outside and which is capable of receiving the male organ.

This cylindrical or tubular member is provided at its terminus with spring members which maintain the tube in a closed position but which may be easily opened when pressure is applied. The spring members are also employed to emulate a spindle upon which the flexible extension is wound. When the tubular member is wound upon the spindle in a spiral fashion a water tight seal is formed so that water cannot enter.

When not in use the closable opening of this tubular member is hidden from view by a hinged flap or fly.

In another embodiment of the invention, the terminus of the tubular member is furnished with a spindle attached to its terminus in such a way that it may be wound and unwound to close and open the closable opening.

It is therefore an object of this invention to provide new and improved waders for use by fly, casting or surf fishermen.

It is yet a further object of this invention to provide waders that allow male fishermen to excrete their urinary waste without the need to undress.

BRIEF DESCRIPTION OF THE DRAWINGS

FIG. 1 is a front elevational view illustrating improved fishing waders in accordance with the invention.

FIG. 2 is a sectional view of FIG. 1 taken along line 2—2 and depicting a spring loaded extension in a wound-up position. A flap is also shown for covering the attached extension.

FIG. 3 is a sectional view of the extension of FIG. 2 in a full length position and is shown as being attached to the waders as a single molded entity.

DESCRIPTION OF THE PREFERRED EMBODIMENT

Figure 4:
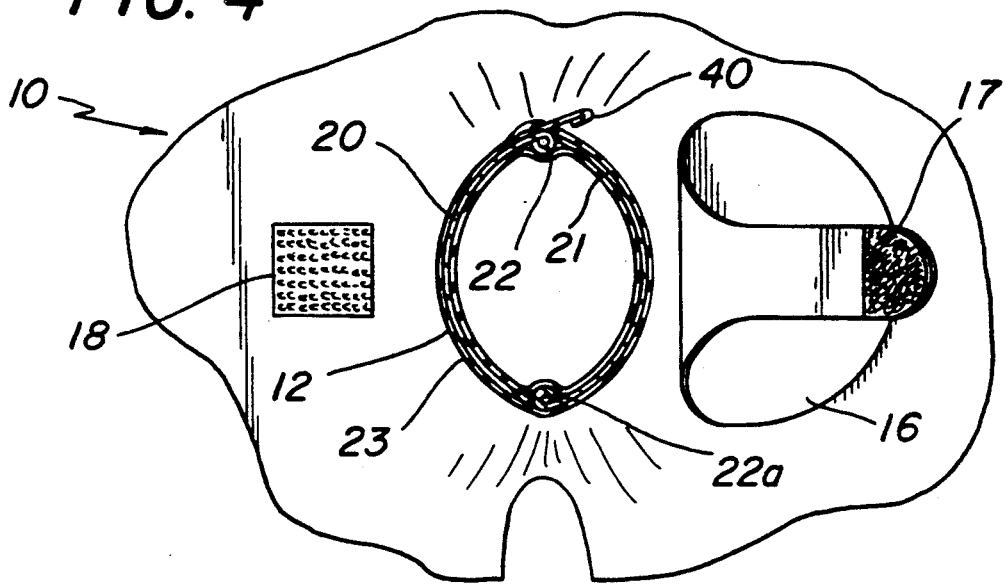
FIG. 4 is a sectional view of FIG. 3 taken along line 4—4 and shows a spring loaded opening into the waders with an accompanying flap.

Referring to the drawings and, in particular, to FIG. 1, there is depicted a fisherman 8 who is engaged in the sport of fishing in a shallow stream. When engaged in this sport, which may be of the fly casting, surf fishing or bait casting type, the fisherman characteristically utilizes an outer protective garment 10 over regular clothing. The outerwear 10 is conventionally referred to as waders and consist of a protective garment that is impervious to water; furthermore, the protective outerwear is designed to integrally cover the feet, legs and a greater portion of the body since its topmost level reaches the middle of the chest area. Dual suspender straps 13, 14 are utilized to loosely maintain the waders 10 in position upon the person of the fisherman so that he can roam from place to place in a stream, river or ocean surf up to the middle of the chest without becoming wet. The main body of the waders 10 may be fabricated from a flexible and thin gauged rubberized or plastic product that is relatively of light weight and allows the user to move freely while maneuvering in a stream or surf. However, the attached boots **10*a*, 10*b*** are of heavier construction for the purpose of comfort as well as to protect the bottom of the fisherman's feet from sharp and dangerous objects.

The waders 10 of the invention include an extendible tubular member 12 which is located in the crotch area for the purpose of allowing the user's penile organ to be extended therethrough. The member 12 allows the user to conveniently expel his urine without removal of the waders 10 after repairing to an appropriate location on the shoreline. The tubular member 12 is designed to be water tight when not in use so that moisture cannot enter the interior of the waders 10 to cause discomfort while engaged in a fishing activity. This feature may be understood with greater clarity by referring to the drawing of FIG. 2.

The sectional view of FIG. 2 illustrates the tubular member 12 being integrally formed into the main body of the waders 10. The member 12 is depicted as being wound into a tight, multi-turn and counterclockwise spiral when not in use to prevent water or moisture from seeping into the garment 10. The spirally wound member 12 when in the inactive or passive state is hidden from view with a flap 16 which is fixedly attached at one end **16*a* to the main body of the waders, and at its opposite end by a semipermanent connection 16*b*. The connection 16*b* is provided by use of two Velcro attaching devices 17, 18. The Velcro connection 16*b* may be clearly seen by referring to the sectional view of FIG. 3 where the male device 17 is located at the end of the flap 16 and the corresponding female device 18 is positioned upon the main body of the waders 10. The devices 17, 18 are respectively affixed to the flap 16 and main body of waders 10** by an appropriate adhesive or alternatively, by sewing. As is readily apparent from FIG. 2, the flap 16 is merely intended to maintain the tubular member 12 in position against the waders 10 while at the same time allowing water to freely pass through when the user is fishing in water that rises above his waist line. The flap 16 is also intended to hide the tubular member 12 in order to make the waders 10 pleasing in appearance when viewed by the front.

The distal end of the member 12 includes a spring 19, which is made up of two leaf members 20, 21 as illustrated in FIG. 2, and as may be viewed in greater detail in FIG. 3. The tubular member 12 is depicted as being fully extended with the flap 16 in an open or detached position. The spring 19 including its two leaf members 20, 21 is embedded peripherally at the distal position of the tubular member 12 by a molding or other suitable expedient. In this manner, the medium for embedding the leaf members 20, 21 is a covering 23 which may be of the same material as the tubular member 12. The extremities of the two leaf springs 20, 21 are joined to one another via hinges 22, 22*a* as may be viewed with greater clarity in the sectional view of FIG. 4.

The spring mechanism 19 as utilized in the instant invention provides a simple expedient for maintaining the tubular member 12 in a closed position when not in use as examplified in FIG. 2; in addition, the distal spring arrangement allows the wearer to open the member 12 from its normally closed position to void his bladder. The opening of the tubular member 12 is facilely obtained by applying light pressure to the outside of hinges 22, 22*a* and squeezing inwardly.

The squeezing or pressure application may be obtained by use of the thumb and index finger of either hand to apply an inward force upon the two hinges; the sectional views of FIGS. 3, 4 depict the open position of member 12 when pressure has been properly applied. When inward pressure is applied to the hinges 22, 22*a*, the respective leaf springs 20, 21 will bulge outwardly in the form of an oblong configuration so that the male penile organ can be inserted therethrough. After the urine discharge has occurred, the male organ is withdrawn from the tubular member 12 and the applied finger pressure is withdrawn so that the distal end collapses and assumes the passive state as shown in FIG. 1.

The collapse of the distal end by the withdrawal of finger pressure causes the leaf springs 19, 20 to collapse and assume a longitudinal position within member 12; the leaf springs 20, 21 thereby become stiffeners to allow the user to readily wind the tubular member 12 into a spiral as shown in the frontal view of FIG. 2. A small tab 40 is attached to leaf spring 20 in order to facilitate the winding of member 12 into the spiral. As previously mentioned, the tight spiral configuration prevents water and moisture from seeping into the waders 10 so that the fisherman remains dry and without discomfort. It should be understood by those skilled in the art that the member 12 may be wound into a tight clockwise or counterclockwise spiral without diminution of performance.

Figure 5:
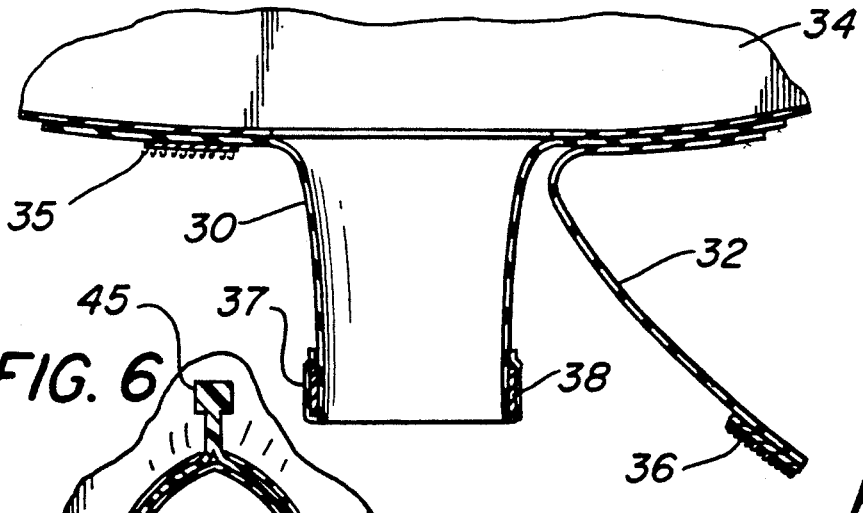
FIG. 5 is a sectional view of the extension element which is physically attached to the waders.

FIG. 5 illustrates another embodiment of the invention where a positioning of the tubular member 30 is upon the outside surface of the waders 34, and is attached with a cement (not shown) or suitable bonding agent. In all other respects, the member 30 is similar to the previously described embodiment of FIG. 2 and operates in a like manner. Accordingly, a flap 32 is provided which is fixedly positioned on top of the member 30 with an appropriate adhesive. The flap 32 includes a male Velcro attaching device 36 and a corresponding female device 35 for covering the tubular member 30 when in an inactive or passive state. In the manner previously described, the member 30 may be wound up into a clockwise or counterclockwise spiral while employing the leaf springs 37, 38 as stiffeners.

Figure 6:
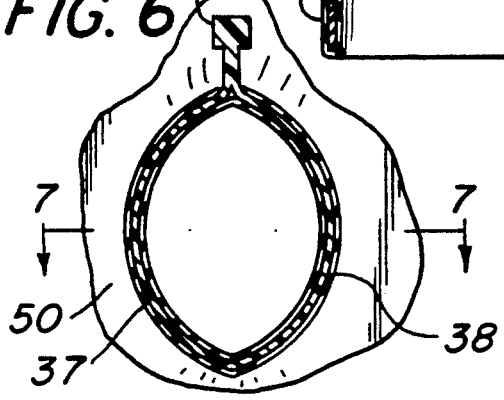
FIG. 6 is another embodiment of the invention with a spring loaded extension and further including a winding stem.
Figure 7:
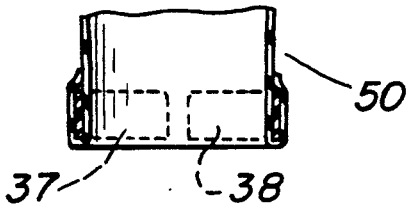
FIG. 7 is a sectional view taken along line 7—7 of FIG. 6 and illustrating the spring member in dotted form.

The sectional view in FIG. 6 depicts another embodiment for facilitating the spiraling of a tubular member 50 when changing from active to an inactive state. To assist the user in this endeavor a stem 45 is provided which is attached to adjacent ends of fork-like plastic strips 37, 38. The strips 37, 38 are unconnected at their opposite ends as may be viewed in the sectional view of FIG. 7. The tubular member 50 is depicted in an open or passive state which is produced by applying pressure at a point adjacent stem 35 and at a position directly opposite. When the pressure is removed the distal end of the member 50 collapses and the strips 37, 38 become stiffeners. The stiffeners 37, 38 in combination with stem 45 are easily wound into a water-tight spiral when the user has no further need for the use of the tubular member 50.

This invention has been described by reference to precise embodiments but it will be appreciated by those skilled in the art that this invention is subject to various modifications and to the extent that those modifications would be obvious to one of ordinary skill they are considered as being within the scope of the appended claims.

What is claimed is:

1. A loose fitting garment impervious to water comprising:
   a) first and second leg and foot coverings;
   b) an approximately chest high body section joined to said first and second coverings;
   c) means for holding said garment in position upon a person;
   d) an integrally formed extendible means located in proximity to a crotch location of said garment to allow expelling of liquid waste from the wearer without removal of said garment and wherein said extendible tubular member and said garment are one piece and meet at a seamless juncture;
   e) a leaf spring means located upon said extendible means at a distal end to maintain said means in a closed position and to assist in the winding of said tubular means into a relatively tight spiral to prevent moisture from entering into the interior of said garment;
   f) a single covering means for placement over said tubular means to cover and retain said tightly would tubular means in place when not in use.

2. A loose fitting garment in accordance with claim 1 wherein said tubular means comprises a member for allowing a male penile organ to be extended therethrough.

3. A loose fitting garment in accordance with claim 1 wherein said spring means comprises two leaf springs which are hinged together.

4. A loose fitting garment in accordance with claim 3 wherein said leaf spring means is hinged at two points to allow the opening of said tubular member by an application of hand pressure.

5. An article of clothing for covering the legs, feet and chest area of a fisherman, the improvement comprising:
   a) an integrally formed extendible tubular member located in the crotch of said article of clothing to allow a fisherman to readily expel his liquid waste product and wherein said extendable tubular member and said article are one piece and meet at a seamless juncture; said tubular member having a distal end having an opening;

b) an expandable leaf spring means located at said distal end of said member to assist in the winding of the member into a relatively tight spiral to prevent moisture from entering into the interior of said clothing, and c) a single flap means for positioning over said tubular member to keep said member in place when not in use.

6. An article of clothing in accordance with claim 5 wherein said leaf spring means includes two oppositely located hinges, said spring means maintaining said tubular member in a normally closed position, and said tubular member being opened by applying minimal pressure upon said two hinges.

* * * * *